US008075276B2

(12) United States Patent
Hwang et al.

(10) Patent No.: US 8,075,276 B2
(45) Date of Patent: Dec. 13, 2011

(54) IMPELLER AND COOLING FAN INCORPORATING THE SAME

(75) Inventors: Ching-Bai Hwang, Taipei Hsien (TW); Po-Hsuan Kuo, Taipei Hsien (TW)

(73) Assignee: Foxconn Technology Co., Ltd., Tu-Cheng, New Taipei (TW)

( * ) Notice: Subject to any disclaimer, the term of this patent is extended or adjusted under 35 U.S.C. 154(b) by 439 days.

(21) Appl. No.: 12/400,779

(22) Filed: Mar. 9, 2009

(65) Prior Publication Data

US 2010/0104449 A1 Apr. 29, 2010

(30) Foreign Application Priority Data

Oct. 28, 2008 (CN) ..... 2008 1 0305248

(51) Int. Cl.
*B63H 1/26* (2006.01)

(52) U.S. Cl. ..... 416/229 R; 416/241 R

(58) Field of Classification Search ..... 416/229 R, 416/241 R

See application file for complete search history.

(56) References Cited

U.S. PATENT DOCUMENTS 5,257,902 A * 11/1993 Atarashi et al. ..... 415/119

FOREIGN PATENT DOCUMENTS

| | | | |
|---|---|---|---|
| JP | 01237399 | * | 9/1989 |
| JP | 03015699 | * | 1/1991 |
| JP | 05196234 | * | 8/1993 |
| JP | 07027387 | * | 1/1995 |
| JP | 2005155437 | * | 6/2005 |

* cited by examiner

*Primary Examiner* — Trung Q Dang
(74) *Attorney, Agent, or Firm* — Altis Law Group, Inc.

(57) ABSTRACT

A cooling fan includes a housing, a cover arranged on the housing, and an impeller received in a space formed between the housing and the cover. The impeller includes a hub and a plurality of blades extending radially and outwardly from the hub. Each of the blades includes a windward surface and a leeward surface opposite to the windward surface. A porous layer is disposed on the leeward surface of each of the blades, adjacent to a free end thereof. The porous layer has one side surface attached to the leeward surface and an opposite side surface facing the windward surface of an adjacent blade.

13 Claims, 3 Drawing Sheets

IMPELLER AND COOLING FAN INCORPORATING THE SAME

BACKGROUND

1. Technical Field

The disclosure relates to cooling fans, and particularly to a cooling fan having an impeller which can have a reduced noise when the impeller rotates.

2. Description of Related Art

It is well known that heat is generated by electronic components such as integrated circuit chips during operation thereof. If the heat is not efficiently removed, these electronic components may suffer damage. Thus, cooling fans are often used to cool the electronic components.

A typical cooling fan includes a housing, a cover on the housing, and a stator and an impeller received in a space defined between the housing and the cover. The impeller includes a hub and a plurality of blades extending radially and outwardly from the hub. Each of the blades includes a windward surface and a leeward surface opposite to the windward surface. When the cooling fan operates, the blades of the impeller drive air therebetween to rotate to generate forced airflow. The airflow flows towards free ends of the blades due to centrifugal force and then separates from the blades adjacent to free ends of the leeward surfaces. The airflow separated from the leeward surfaces generates a vortex adjacent to the free ends of the blades. The vortex generates noise which makes a user near the cooling fan feel uncomfortable.

What is needed, therefore, is an impeller and a cooling fan which can overcome the described limitations.

BRIEF DESCRIPTION OF THE DRAWINGS

Many aspects of the present cooling fan can be better understood with reference to the following drawings. The components in the drawings are not necessarily drawn to scale, the emphasis instead being placed upon clearly illustrating the principles of the disclosed cooling fan. Moreover, in the drawings, like reference numerals designate corresponding parts throughout the several views.

DETAILED DESCRIPTION

Figure 1:
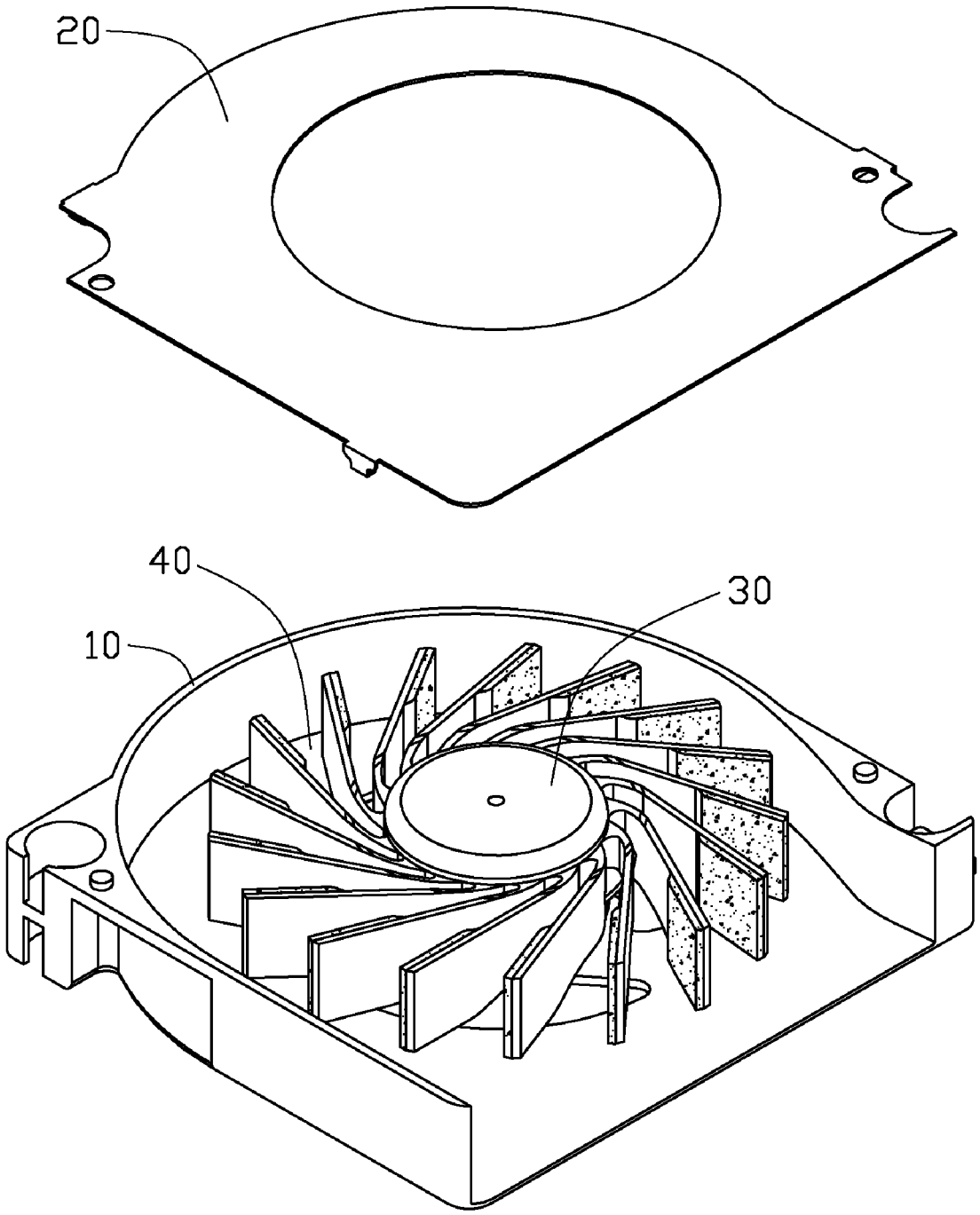
FIG. 1 is an exploded, isometric view of a cooling fan in accordance with one embodiment of the disclosure.

Reference will now be made to the drawing figures to describe the embodiments in detail.

Referring to FIG. 1, a cooling fan in accordance with one embodiment of the disclosure is shown. The cooling fan includes a housing 10, a cover 20 arranged on the housing 10, and a stator and an impeller 30 received in a space 40 defined between the housing 10 and the cover 20.

Figure 2:
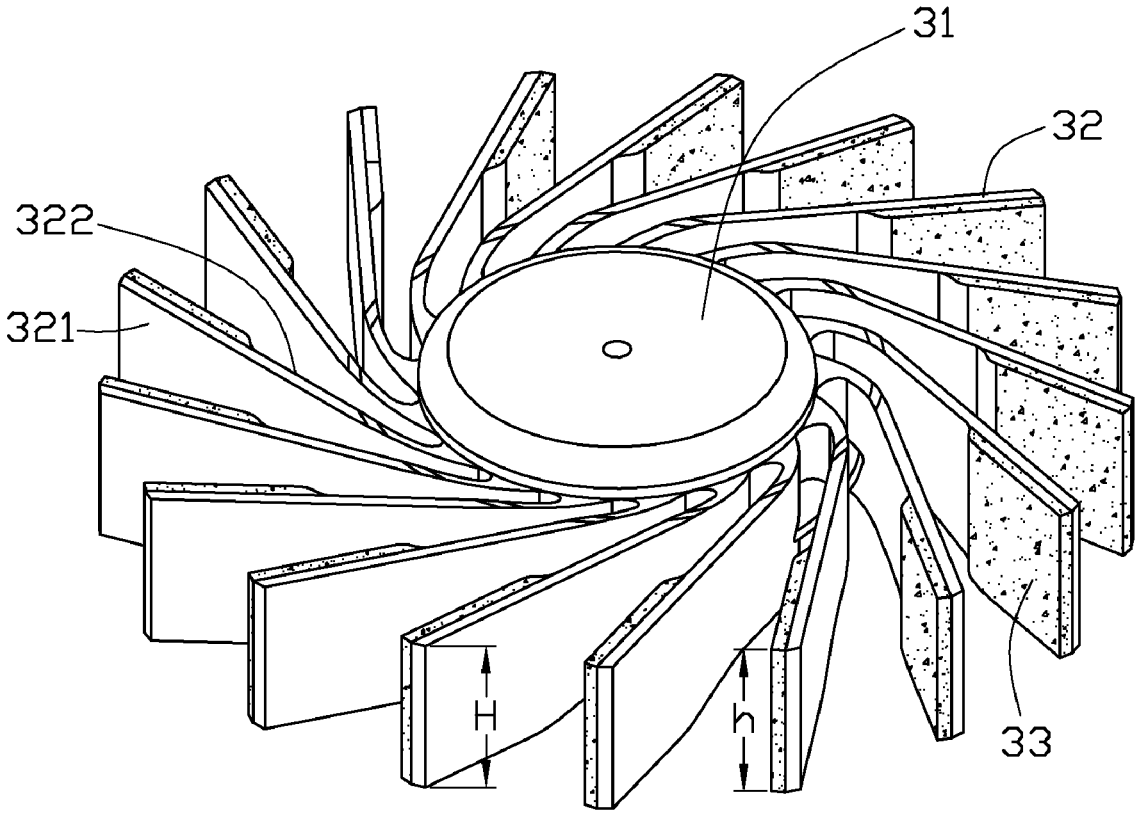
FIG. 2 is an enlarged, isometric view of an impeller of the cooling fan of FIG. 1.
Figure 3:
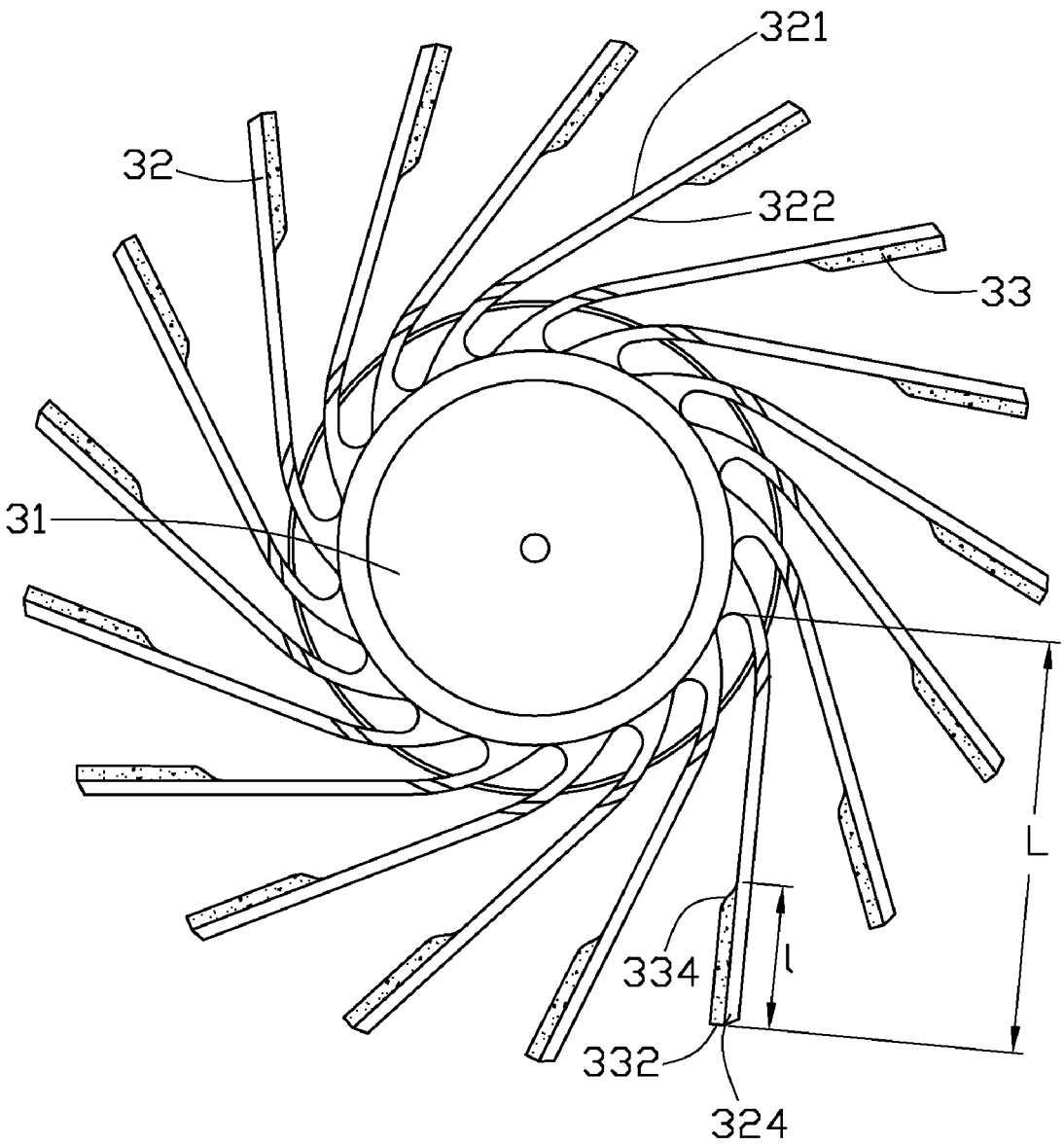
FIG. 3 is a top plan view of the impeller of FIG. 2.

Referring to FIGS. 2 and 3, the impeller 30 includes a hub 31 and a plurality of blades 32 extending radially and outwardly from an outer periphery of the hub 31. Each of the blades 32 includes a windward surface 321 and a leeward surface 322 opposite to the windward surface 321. Each windward surface 321 faces the leeward surface 322 of an adjacent anterior blade 32.

A porous layer 33 is intimately adhered to the leeward surface 322 adjacent to a free end 324 of each blade 32. The porous layer 33 is of porous, acoustic absorbing material, such as sponge, foamed plastic, glass wool and fibers. The porous layer 33 is rectangular and laminar, with one side surface thereof attached to the leeward surface 322 of each blade 32, and an opposite side surface thereof facing the windward surface 321 of an adjacent posterior blade 32. A height h of the porous layer 33 along an axial direction of the hub 31 is equal to a height H of each blade 32, and the porous layer 33 does not extend beyond each blade 32 along the axial direction of the hub 31. A length 1 of the porous layer 33, along an extending direction of a corresponding blade 32, i.e., a radial direction of the hub 21, to which the porous layer 33 is attached, is one third of a length L of the corresponding blade 32. The porous layer 33 includes an outer side 332 away from the hub 31 and an inner side 334 adjacent to the hub 31. The outer side 332 is aligned with an outer edge of the free end 324 of the corresponding blade 32 along a circumferential direction of the impeller 30 and perpendicular to the leeward surface 322. The inner side 334 is an inclined surface, slanting rearwards toward the corresponding blade 32 to thereby have a smooth connection with the corresponding blade 32. Alternatively, the height h of the porous layer 33 can be less than the height H of each blade 32 along the axial direction of the hub 31. The length of the porous layer 33 along the extending direction of the corresponding blade 32 is one third to a half of the length of the corresponding blade 32.

During operation of the cooling fan, the blades 32 of the impeller 30 drive airflow between two adjacent blades 32 to rotate to flow from the windward surface 321 of the posterior blade 32 of the two adjacent blades 32 towards the leeward surface 322 of the anterior blade 32 of the two adjacent blades 32, and then towards the free end 324 of the anterior blade 32 due to centrifugal force. The porous layer 33 attached to the leeward surface 322 adjacent to the free end 324 of each blade 32 absorbs the airflow, which delays a separation between the airflow and the blade 32. Thus, a vortex adjacent to the free end 324 of each blade 32 is reduced, and a vortex noise generated by the vortex is accordingly reduced. In addition, the porous layer 33 can absorb the vortex noise, which further reduces the noise of the cooling fan.

Table 1 below shows experimental data of the cooling fan of FIGS. 1 to 3 compared with a typical cooling fan. A rotation speed of the cooling fan of FIGS. 1 to 3 and the typical cooling fan is 3500 rpm. As compared to the typical cooling fan, the noise of the cooling fan of FIGS. 1 to 3 is obviously reduced.

TABLE 1

| | rotation speed (rmp) | Noise (dBA) |
|---|---|---|
| Cooling fan of FIGS. 1 to 3 | 3500 | 34.5 |
| Typical cooling fan | 3500 | 37.7 |

It is believed that the disclosure and its advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An impeller for an electrical fan for cooling electronic components, comprising:

a hub;

a plurality of blades extending radially and outwardly from the hub, each of the blades comprising a windward surface and a leeward surface opposite to the windward surface; and a porous layer disposed on the leeward surface of each of the blades adjacent to a free end thereof, the porous layer having one side surface attached to the leeward surface and an opposite side surface facing the windward surface of an adjacent blade;

wherein the porous layer comprises an outer side away from the hub, the outer side being aligned with an outer edge of the free end of the corresponding blade to which the porous layer is attached, and an inner side adjacent to the hub, the inner side being inclined, slanting rearwards toward the corresponding blade to thereby have a smooth connection with the corresponding blade.

2. The impeller of claim 1, wherein the porous layer is of porous, acoustic absorbing material.

3. The impeller of claim 2, wherein the porous layer is made of one of sponge, foamed plastic, glass wool and fibers.

4. The impeller of claim 1, wherein the porous layer is laminar, and a height of the porous layer along an axial direction of the hub is not larger than a height of each blade therealong.

5. The impeller of claim 1, wherein the porous layer is laminar, and a length of the porous layer along an extending direction of the corresponding blade to which the porous layer is attached is one third to a half of a length of the corresponding blade therealong.

6. The impeller of claim 5, wherein the length of the porous layer along the extending direction of the corresponding blade is one third of the length of the corresponding blade therealong.

7. The impeller of claim 1, wherein the porous layer is intimately adhered on the leeward of each of the blades.

8. A cooling fan comprising:

a housing;

a cover on the housing; and an impeller received in a space defined between the housing and the cover, the impeller comprising a hub and a plurality of blades extending radially and outwardly from the hub, each of the blades comprising a windward surface and a leeward surface opposite to the windward surface, a porous layer disposed on the leeward surface of each of the blades adjacent to a free end thereof, the porous layer having one side surface thereof attached to the leeward surface and an opposite side surface thereof facing the windward surface of an adjacent blade;

wherein the porous layer comprises an outer side away from the hub, the outer side being aligned with an outer edge of the free end of the corresponding blade to which the porous layer is attached, and an inner side adjacent to the hub, the inner side being inclined, slanting rearwards toward the corresponding blade to thereby have a smooth connection therewith.

9. The cooling fan of claim 8, wherein the porous layer is of porous, acoustic absorbing material.

10. The cooling fan of claim 9, wherein the porous layer is made of one of sponge, foamed plastic, glass wool and fibers.

11. The cooling fan of claim 8, wherein the porous layer is laminar, and a height of the porous layer along an axial direction of the hub is not larger than a height of each blade therealong.

12. The cooling fan of claim 8, wherein the porous layer is laminar, and a length of the porous layer along an extending direction of the corresponding blade to which the porous layer is attached is one third to a half of a length of the corresponding blade therealong.

13. The cooling fan of claim 12, wherein the length of the porous layer along the extending direction of the corresponding blade is one third of the length of the corresponding blade therealong.

* * * * *